US010244814B2

(12) United States Patent
McNamara-Schwartz

(10) Patent No.: US 10,244,814 B2
(45) **Date of Patent: *Apr. 2, 2019**

(54) MODULAR SHOE WITH INTERCHANGEABLE COMPONENTS AND METHOD OF ATTACHMENT

(71) Applicant: FLOP GIRL, LLC, Mt. Kisco, NY (US)

(72) Inventor: Kara McNamara-Schwartz, Mt. Kisco, NY (US)

(73) Assignee: Flop Girl LLC, Mount Kisco, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/430,789

(22) Filed: Feb. 13, 2017

(65) Prior Publication Data

US 2017/0245583 A1 Aug. 31, 2017

Related U.S. Application Data

(63) Continuation of application No. 14/152,071, filed on Jan. 10, 2014, now Pat. No. 9,603,410.

(60) Provisional application No. 61/763,977, filed on Feb. 13, 2013.

(51) Int. Cl.

| | |
|---|---|
| ***A43B 21/42*** | (2006.01) |
| ***A43B 3/24*** | (2006.01) |
| ***A43B 23/24*** | (2006.01) |
| ***A43B 3/00*** | (2006.01) |
| ***A43B 3/12*** | (2006.01) |
| ***A43B 3/02*** | (2006.01) |
| ***A43B 5/12*** | (2006.01) |

(52) U.S. Cl.

CPC ..... *A43B 3/242* (2013.01); *A43B 3/0078* (2013.01); *A43B 3/02* (2013.01); *A43B 3/122* (2013.01); *A43B 3/126* (2013.01); *A43B 3/246* (2013.01); *A43B 5/12* (2013.01); *A43B 21/42* (2013.01); *A43B 23/24* (2013.01)

(58) Field of Classification Search

CPC ... A43B 1/0027; A43B 1/0036; A43B 3/0078; A43B 3/246; A43B 21/42; A43B 21/22; A43B 21/52; A43B 21/37; A43B 21/39; A43B 23/24

USPC ..... 36/100, 136, 41, 42, 72 B, 73

See application file for complete search history.

(56) References Cited

U.S. PATENT DOCUMENTS

| | | | |
|---|---|---|---|
| 723,754 | A | 3/1903 | Sullivan et al. |
| 1,066,305 | A | 7/1913 | Mitchell |
| 1,230,775 | A | 6/1917 | Popovich |
| 1,343,602 | A | 6/1920 | Williams |
| 1,343,638 | A | 6/1920 | Mitchell |
| 1,743,543 | A | 1/1930 | Gutierrez |
| 1,841,027 | A | 1/1932 | Gruber |
| 1,888,617 | A | 11/1932 | Bridi |
| 1,903,004 | A | 3/1933 | Mariani |
| 1,955,159 | A | 4/1934 | Winget |
| 1,966,293 | A | 7/1934 | Gillis |
| 1,994,508 | A | 3/1935 | Filippelli |

(Continued)

*Primary Examiner* — Ted Kavanaugh

(74) *Attorney, Agent, or Firm* — Ohlandt, Greeley, Ruggiero & Perle, L.L.P.

(57) ABSTRACT

The modular shoe assembly described herein has a removable heel band. This allows a user to customize the shoe in limitless ways, as the heel bands can have any variety of colors, patterns, prints, embossments, or other ornamental decorations such as beads or pearls. The shoe assembly may be a sandal, ballet shoe, loafer, boot, or similar design.

11 Claims, 4 Drawing Sheets

(56) References Cited

U.S. PATENT DOCUMENTS

| | | | |
|---|---|---|---|
| 1,998,012 | A | 4/1935 | Grant |
| 2,063,042 | A | 12/1936 | Mauser |
| 2,076,514 | A | 4/1937 | Huffman |
| 2,109,193 | A | 2/1938 | Field et al. |
| 2,153,968 | A | 4/1939 | Loufbahn |
| 2,183,218 | A | 12/1939 | Hewson |
| 2,233,250 | A | 2/1941 | Easton |
| 2,252,404 | A | 8/1941 | Mauser |
| 2,367,232 | A | 1/1945 | Marx |
| 2,431,868 | A | 12/1947 | Gilmour |
| 2,461,977 | A | 2/1949 | Gilmour |
| 2,491,297 | A | 12/1949 | Brown |
| 2,492,013 | A | 12/1949 | Sorofman |
| 2,582,551 | A | 1/1952 | Malherbe |
| 2,607,133 | A | 8/1952 | Marlowe |
| 2,795,867 | A | 6/1957 | Zuckerman et al. |
| 2,802,285 | A | 8/1957 | Griffin |
| 2,928,191 | A | 3/1960 | Meltzer |
| 2,954,618 | A | 10/1960 | Rados |
| 2,976,623 | A | 3/1961 | Gallaway |
| 3,192,652 | A | 7/1965 | Melchiorre |
| 3,318,026 | A | 5/1967 | Antelo |
| 3,570,147 | A | 3/1971 | Chiu |
| 3,581,413 | A | 6/1971 | Simonetti |
| 3,646,497 | A | 2/1972 | Gillikin |
| 3,925,915 | A | 12/1975 | Colli |
| 3,983,642 | A | 10/1976 | Liao |
| 4,115,933 | A | 9/1978 | Chiaramonte, Jr. |
| 4,214,384 | A | 7/1980 | Gonzalez R. |
| 4,297,798 | A | 11/1981 | Colan |
| 4,450,633 | A | 5/1984 | Connelly |
| 4,461,102 | A | 7/1984 | DeVincentis |
| 4,756,097 | A | 7/1988 | Sanders |
| 4,887,369 | A | 12/1989 | Bailey et al. |
| 5,025,574 | A | 6/1991 | Lasher, III |
| 5,052,129 | A | 10/1991 | Lobasso et al. |
| 5,311,676 | A | 5/1994 | Hughes et al. |
| 5,347,730 | A | 9/1994 | Rodriguez Colon |
| 5,373,649 | A | 12/1994 | Choi |
| 5,419,060 | A | 5/1995 | Choi |
| 5,519,950 | A | 5/1996 | Wang |
| D378,548 | S | 3/1997 | Harmon, II |
| D384,495 | S | 10/1997 | Watson |
| 5,692,322 | A | 12/1997 | Lombardino |
| 5,992,058 | A | 11/1999 | Jneid |
| 6,848,199 | B1 | 2/2005 | Giannelli |
| 7,243,443 | B2 | 7/2007 | Swigart |
| 7,272,899 | B1 | 9/2007 | Marak |
| 7,562,468 | B2 | 7/2009 | Ellis, III |
| 7,650,704 | B2 | 1/2010 | Richardson |
| D630,826 | S | 1/2011 | Boyer |
| 7,866,062 | B2 | 1/2011 | Yang |
| D639,537 | S | 6/2011 | Countee et al. |
| 7,954,256 | B2 | 6/2011 | Colella |
| 7,954,260 | B2 | 6/2011 | Enderson |
| 8,015,731 | B2 | 9/2011 | Jackson |
| 8,020,319 | B1 | 9/2011 | Mohaupt |
| 8,112,906 | B2 | 2/2012 | Paik |
| 8,141,275 | B1 | 3/2012 | Donaldson et al. |
| 8,151,491 | B2 | 4/2012 | Sarantakos |
| D664,747 | S | 8/2012 | Ma |
| 8,307,571 | B1 | 11/2012 | Ceylan |
| 8,434,246 | B2 | 5/2013 | Enderson |
| 8,448,351 | B2 | 5/2013 | Aveni |
| 8,839,529 | B1 | 9/2014 | Levy |
| 8,914,992 | B1 | 12/2014 | Kaufman et al. |
| 9,015,963 | B1 | 4/2015 | Dominguez |
| 9,032,644 | B1 | 5/2015 | Koo et al. |
| 9,603,410 | B2 * | 3/2017 | McNamara-Schwartz ..... A43B 3/0078 |
| 2008/0235993 | A1 | 10/2008 | Wegner |
| 2009/0038181 | A1 | 2/2009 | Loughnane |
| 2009/0241319 | A1 | 10/2009 | Kilgore et al. |
| 2010/0000126 | A1 | 1/2010 | Ortner |
| 2010/0018076 | A1 | 1/2010 | Buck |
| 2010/0186258 | A1 | 7/2010 | Garza |
| 2011/0197474 | A1 | 8/2011 | Mahmoud |
| 2011/0283564 | A1 | 11/2011 | Stillwagon |
| 2012/0137543 | A1 | 6/2012 | Kemp |
| 2012/0186105 | A1 | 7/2012 | Kemp et al. |
| 2012/0204359 | A1 | 8/2012 | Adami et al. |
| 2012/0216429 | A1 | 8/2012 | Bastida et al. |
| 2012/0227289 | A1 | 9/2012 | Beers et al. |
| 2012/0233890 | A1 | 9/2012 | Masters |
| 2013/0019496 | A1 | 1/2013 | Mizrahi-Shapiro |
| 2013/0067770 | A1 | 3/2013 | Sherwood et al. |
| 2013/0091732 | A1 | 4/2013 | Mendoza |
| 2013/0091736 | A1 | 4/2013 | Worley |
| 2013/0097893 | A1 | 4/2013 | Rabinovitch |
| 2013/0206619 | A1 | 8/2013 | Angiulo et al. |
| 2013/0306501 | A1 | 11/2013 | Angiulo et al. |
| 2013/0312285 | A1 | 11/2013 | Sharma et al. |
| 2013/0318827 | A1 | 12/2013 | Ringholz |
| 2013/0340285 | A1 | 12/2013 | Blowers |
| 2013/0340286 | A1 | 12/2013 | Schindler |
| 2014/0000126 | A1 | 1/2014 | Nelson-Warren |
| 2014/0007458 | A1 | 1/2014 | Berger et al. |
| 2014/0013621 | A1 | 1/2014 | Dupree et al. |
| 2014/0075783 | A1 | 3/2014 | Licht |
| 2014/0075787 | A1 | 3/2014 | Cartagena |
| 2014/0096413 | A1 | 4/2014 | Anderson |
| 2014/0137436 | A1 | 5/2014 | Saccullo et al. |
| 2014/0230286 | A1 | 8/2014 | Paugh et al. |
| 2014/0259777 | A1 | 9/2014 | Morris Thill |
| 2014/0259778 | A1 | 9/2014 | Anderson |
| 2014/0259779 | A1 | 9/2014 | Hashish et al. |
| 2014/0298684 | A1 | 10/2014 | Young |
| 2014/0298685 | A1 | 10/2014 | Alan et al. |
| 2014/0305007 | A1 | 10/2014 | Skaggs et al. |
| 2014/0317961 | A1 | 10/2014 | Mathis |
| 2014/0352171 | A1 | 12/2014 | Hillyer |
| 2015/0020414 | A1 | 1/2015 | Mulholland |
| 2015/0101210 | A1 | 4/2015 | Jang |
| 2015/0143719 | A1 | 5/2015 | Fosbrook |

* cited by examiner

MODULAR SHOE WITH INTERCHANGEABLE COMPONENTS AND METHOD OF ATTACHMENT

CROSS-REFERENCE TO RELATED APPLICATIONS

The present application is a continuation of U.S. patent application Ser. No. 14/152,071, filed on Jan. 10, 2014, which in turn claims priority to U.S. Provisional Patent Application No. 61/763,977, filed on Feb. 13, 2013, each of which is herein incorporated by reference.

BACKGROUND OF THE DISCLOSURE

1. Field of the Disclosure

The present disclosure relates generally to footwear, and more particularly to a shoe with removable heel sections to change heel decor. The removable heel sections can have varying designs and appearances.

2. Description of the Related Art

Footwear, such as shoes, boots, and sandals are typically purchased in a finished state. Thus, no further customization is typically available after purchase, other than permanent defacing, or otherwise personal customization by the user. Recently, customizable shoes and sandals have been provided, allowing for the user to make decorative changes to these items after purchase. Such modifications have generally been limited to the affixing of ornamental features to existing structural features of such footwear. There is a need for a shoe design with enhanced flexibility in adjusting structural features.

SUMMARY OF THE DISCLOSURE

The present disclosure has determined that the various shoes previously described fail to meet all desired customization requirements of a preferred shoe. Various embodiment of the present invention may include one or more of the following features. First, a one piece sole is provided for the shoe. The sole can be provided with an attached partial, routed heel with base. This allows for modular, decorative heel sections to be attached to change the heel decoration and complete the heel for wearing. The heel decoration will be manufactured in a number of various designs, including, but not limited to beads, pearls, ribbon, single or multiple strands of cording, or the like. The heel decoration can take shape in any heel size (height, width, circumference) as well as shoe heel style (flat, pump, wedge, spike, or others).

An interchangeable heel band may also be provided. The heel band can be coupled to, and decoupled from, the heel, in the manner described below. Colors, textures, materials and shapes of one or more heel ornamentations may be changed to provide a variety of selections to be chosen by a user.

Still other objects and advantages of the invention will in part be obvious and will in part be apparent from the specification and drawings.

DETAILED DESCRIPTION OF THE DISCLOSURE

Figure 1:
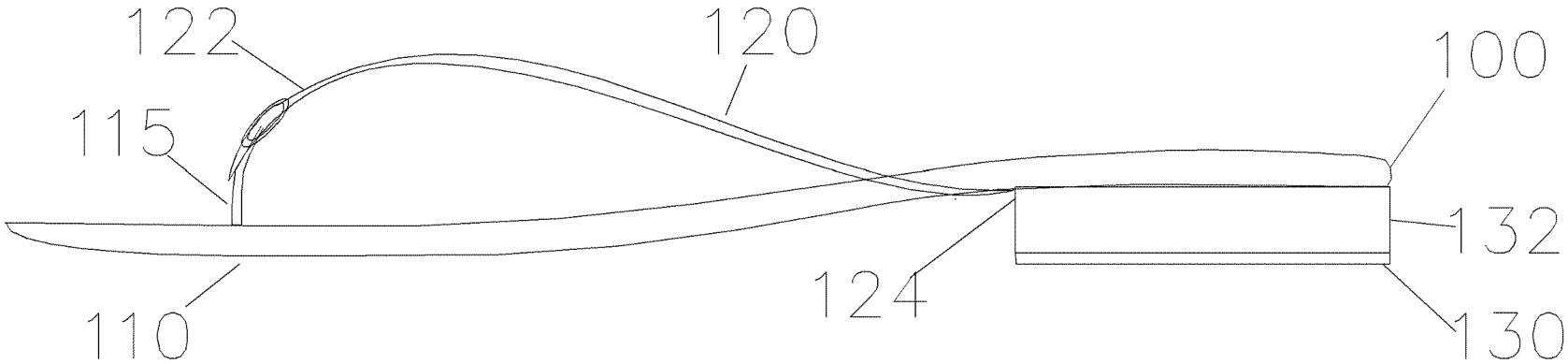
FIG. 1 shows a side plan view of the shoe of the present disclosure.

Referring to the drawings, and in particular FIG. 1, a first embodiment of shoe 100 of the present disclosure is shown. Shoe 100 has sole 110, toe prong 115, foot housing strap 120, and heel 130. Heel 130 has a removably connected band 132 that fits around a circumference thereof. As discussed in greater detail below, with shoe 100, a user can very easily swap out different structural features and ornamental designs to their liking by utilizing different foot housing straps 120 and/or bands 132. This arrangement provides significant advantages over currently available shoe designs. In most current shoes, the structural and ornamental aspects of the shoe are fixed upon manufacture, and the user has no option to customize other than permanent alteration or defacement. With shoe 100, by simply connecting and disconnecting heel band 132, the user has limitless options for their footwear.

In the present disclosure, unless otherwise specified, the term "shoe" describes any footwear for a user. This includes sandals, boots, open- or closed-toe designs, ballet shoes, loafers, or other designs. The "front" of a shoe is the area where a user's toes would be located, and the "rear" is where the user's heel is located when they are wearing shoe 100. A "top" orientation aligns with the top of the user's feet, and the "bottom" direction is the bottom of the user's foot, the sole 110 of shoe 100, or on the bottom of sole 110. For ease of description, "upper" is used synonymously with the term "foot housing strap".

Sole 110 can be made with any number of suitable processes, such as by hand, machine fabrication, or injection molded. Sole 110 can be a unitary element, but may also have a non-unitary construction, with two or more separate parts connected to each other.

The materials in shoe 100 can be any suitable for use as described above, and as with sole 110, can be hand-made, fabricated by machine, or injection molded. Examples include wood, cork, leather, plastic, or combinations thereof. Heel 130 and band 132 can be made of materials such as, but not limited to, wood, cork, leather, silicone, urethane, ethylene vinyl acetate, and/or clear polymers.

Figure 2A:
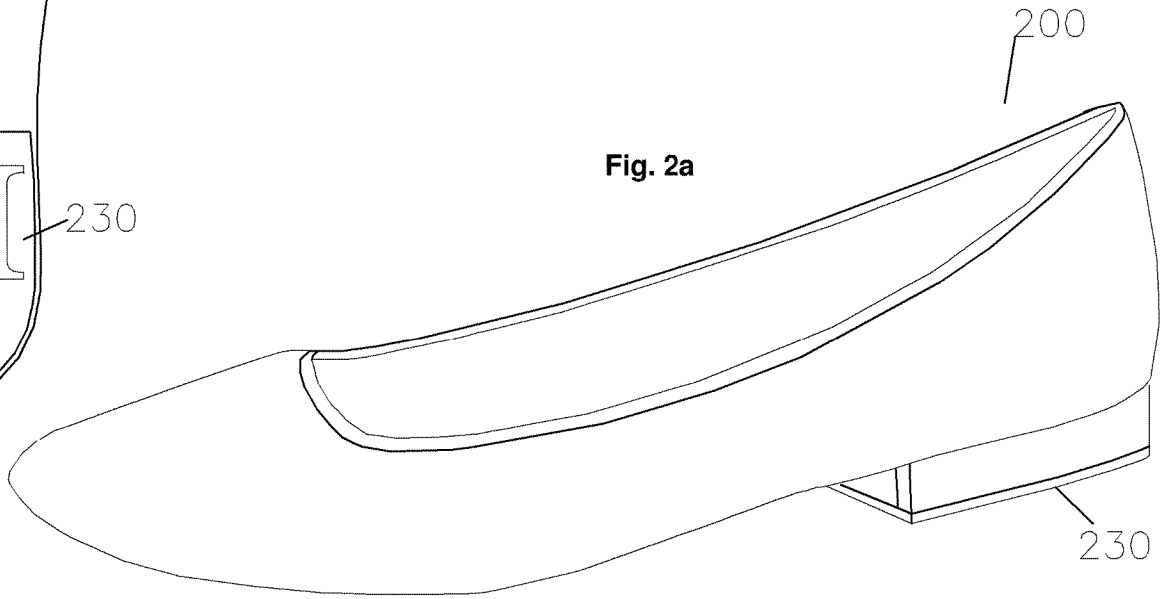
FIG. 2*a* shows a top, perspective view of a second embodiment of the shoe of the present disclosure.
Figure 2B:
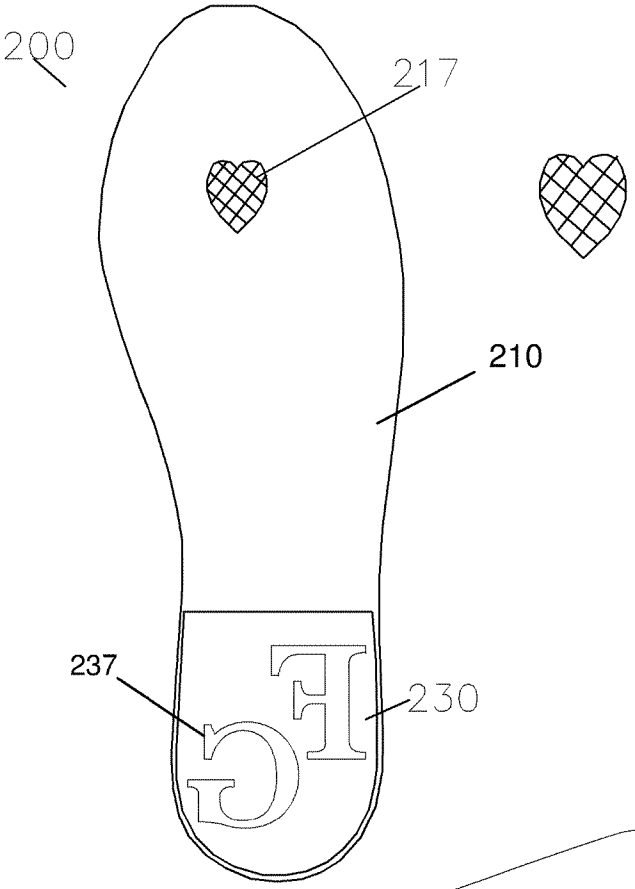
FIG. 2*b* shows a bottom view of the shoe of FIG. 2*a;*

Referring to FIGS. 2*a* and 2*b*, a second embodiment of the shoe of the present disclosure is shown, and referred to by reference number 200. Shoe 200 is a closed-toe shoe, and therefore does not utilize uppers as in shoe 100. Shoe 200 can also have a logo or other text on a heel tread 237 of heel 230, or have a decorative element 217 recessed into sole 210.

Figure 3:
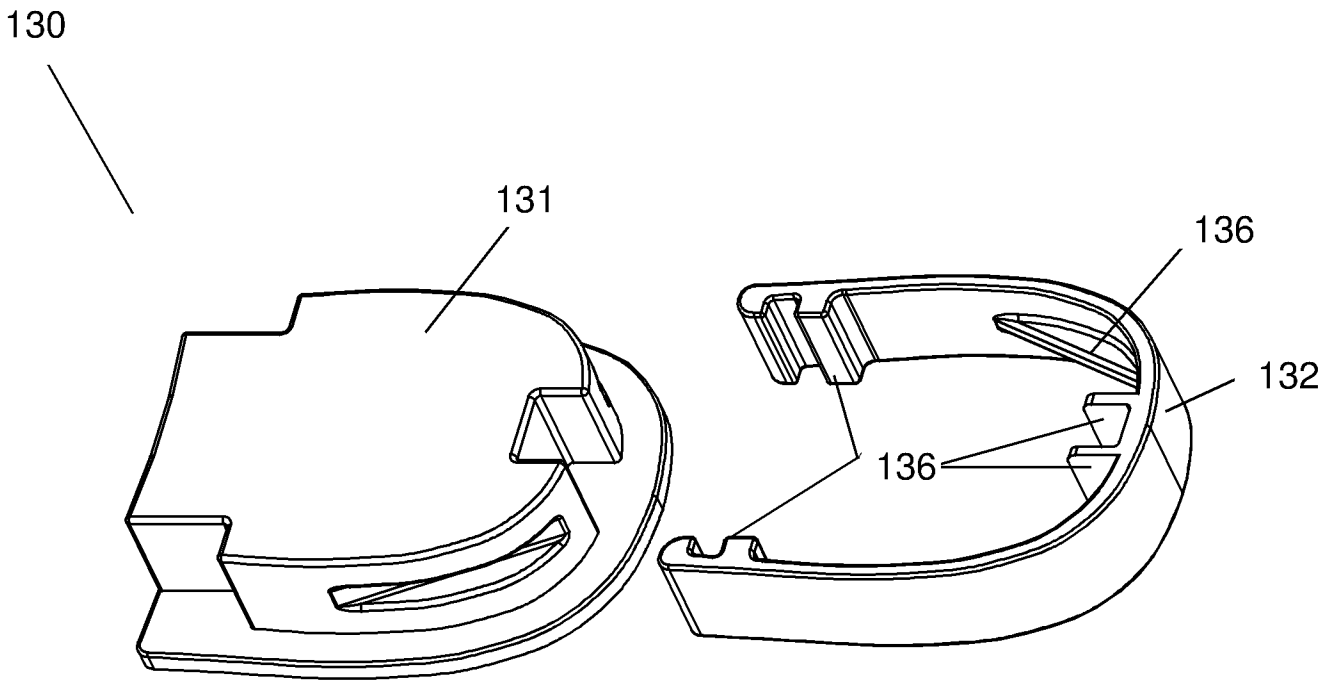
FIG. 3 shows an exploded view of the heel of the shoe of FIG. 2*a;*
Figure 4B:
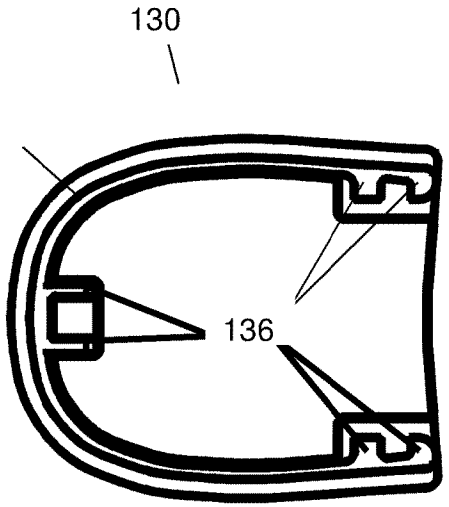
FIG. 4*b* shows a bottom view of the heel of FIG. 3.
Figure 4A:
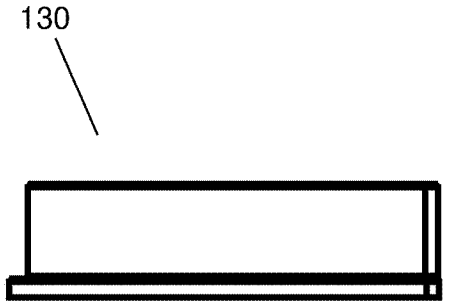
FIG. 4*a* shows a side elevation view of the heel of FIG. 3.
Figure 4C:
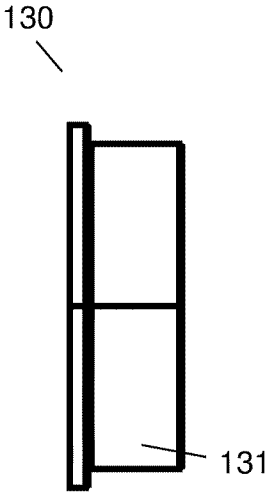
FIG. 4*c* shows a rear elevation view of the heel of FIG. 3.
Figure 4D:
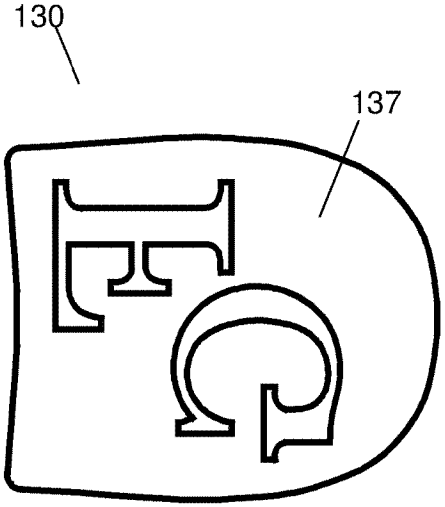
FIG. 4*d* shows a bottom view of the heel of FIG. 3 with a covering thereon.

Referring to FIGS. 3-4*d,* band 132 can fit around an exterior lateral circumference of base 131 of heel 130. In the shown embodiment, band 132 is horseshoe-shaped, but other shapes are contemplated by the present disclosure, such as rectangular or with squared-off corners.

The exterior surface of band 132 can have an ornamental design, which can include and variety or number of colors, patterns, textures, embossments, or the like. Band 132 can also have decorative objects on its exterior surface, for example stones or beads. This provides yet another easily customizable feature of shoe 100 for the user. As discussed below, band 132 can be easily connected to and removed from base 131 of heel 130.

Band 132 can have a number of ribs 136 at ends thereof, or projecting out from an interior surface thereof. Some of ribs 136 can be at the rear of band 136, and can fit into a notch in the rear end of base 131. Ribs 136 at the front ends of band 132 snap fit around an edge of base 131, to secure band 132 in place. The user removes band 132 simply by moving ribs 136 around base 131. A heel tread 137 can fit over base 131 and band 132, to help secure them all in place and protect heel 130 from the ground when shoe 100 is in use. Heel tread 137 can have a logo or other printed material thereon. Heel tread 137 can be either permanently or removably connected to base 131 or the other components of heel 130.

In accordance with any of the described embodiments of the invention, additional ornamentation may be provided on any of the components of the described shoes. These components may be provided of any desired material. Additionally, while the heels of the shoes described above are shown as flat elements, a higher heel may alternatively be provided to provide any type of desired look. Furthermore, while a sliding mechanism is shown for attaching the heel portion, other coupling schemes may be employed to properly retain the heel relative to the sole of the sandal or shoe. On the top side of the sole, functional or decorative interchangeable heel and "ball of the foot" pads or cushions may be provided, allowing for the choice of a number of designs, fabrics, trims and colors.

While the present disclosure has been described with reference to one or more particular embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure.

What is claimed is:

1. A modular shoe assembly, comprising:

a sole comprising a front end, a heel end, a top surface, and a bottom surface; and a heel connected to the bottom surface of the sole, at the heel end;

wherein the heel further comprises:

a base, the base having a heel upper surface connected to the bottom surface of the sole, a heel bottom surface on an opposite side of the base from the upper surface, a front, a back, and lateral sides, wherein the front side of the base has routed corners; and a heel band removably connected to the base, wherein the heel band has two ends, and a rib on an interior surface of the heel band at each end, so that each of the ribs sit in the routed corners at the front of the base.

2. The shoe assembly of claim 1, wherein each of the base and the heel band are made of plastic.

3. The shoe assembly of claim 1, wherein the heel band is horseshoe-shaped, and the base of the heel has a shape generally conforming to the heel band, at a point of connection between the two.

4. The shoe assembly of claim 1, wherein the heel band has a third rib projecting from an interior surface thereof, wherein the third rib is vertical and mates with a corresponding recess in the back of the base.

5. The shoe assembly of claim 1, wherein when the heel band is connected to the base, each of the ribs engage and wrap around the base at the front, and the ends of the heel band are flush with the front of the heel base.

6. The shoe assembly of claim 1, further comprising a tread covering the heel bottom surface.

7. The shoe assembly of claim 6, wherein the heel band is flush with the tread when connected to the base of the heel.

8. The shoe assembly of claim 1, wherein the heel band has a decoration on an exterior surface thereof.

9. The shoe assembly of claim 8, wherein the decoration is selected from the group consisting of an embossment, pattern, bead, stone, and any combination thereof.

10. The shoe assembly of claim 1, wherein at least one of the base and the heel band are injection molded.

11. The shoe assembly of claim 1, wherein the heel band engages the front of the base with a snap fit.

* * * * *